US007637226B1

(12) United States Patent
Bradley

(10) Patent No.: US 7,637,226 B1
(45) Date of Patent: Dec. 29, 2009

(54) EMERGENCY FLAG APPARATUS AND ASSOCIATED METHOD

(76) Inventor: Gina Bradley, 315 S. Trooper Rd., Norristown, PA (US) 19403

( * ) Notice: Subject to any disclaimer, the term of this patent is extended or adjusted under 35 U.S.C. 154(b) by 30 days.

(21) Appl. No.: 11/999,945

(22) Filed: Dec. 10, 2007

(51) Int. Cl.
*G09F 17/00* (2006.01)

(52) U.S. Cl. ..... 116/28 R; 116/173; 116/63 P; 40/591; 40/608; 40/607.1; 248/121; 248/205.1; 248/206.5

(58) Field of Classification Search ..... 116/28 R, 116/173, 209, 63 P; 40/591, 608, 607.03, 40/607.04, 607.1, 500; 248/121, 125.7–125, 248/9, 205.1, 205.3, 206.5
See application file for complete search history.

(56) References Cited

U.S. PATENT DOCUMENTS

| | | | | | |
|---|---|---|---|---|---|
| 591,199 | A | | 10/1897 | Stafford | |
| 2,324,614 | A | * | 7/1943 | Dalton | 116/28 R |
| 3,003,737 | A | * | 10/1961 | Mehr | 248/279.1 |
| 3,148,856 | A | | 9/1964 | Orlando | |
| 3,540,406 | A | * | 11/1970 | Dexter | 116/28 R |
| 4,800,834 | A | * | 1/1989 | Feng | 116/173 |
| 4,944,656 | A | * | 7/1990 | Feng et al. | 116/173 |
| 5,005,512 | A | * | 4/1991 | Fu | 116/173 |
| 5,343,825 | A | * | 9/1994 | Gazecimeon et al. | 116/173 |
| 5,540,181 | A | * | 7/1996 | Pearce | 116/173 |
| 5,572,835 | A | * | 11/1996 | Atkins et al. | 52/111 |
| 6,057,787 | A | * | 5/2000 | Kell et al. | 340/984 |
| 6,378,453 | B1 | | 4/2002 | Conway | |
| 6,481,366 | B1 | * | 11/2002 | Patera | 116/209 |
| 6,584,927 | B1 | * | 7/2003 | Iversen et al. | 116/173 |
| 6,951,185 | B1 | * | 10/2005 | Wiese | 116/173 |
| 6,962,126 | B1 | * | 11/2005 | Payson | 116/303 |
| 6,975,221 | B2 | * | 12/2005 | Monck | 340/539.11 |
| 2005/0252439 | A1 | * | 11/2005 | Payson | 116/303 |
| 2007/0164854 | A1 | * | 7/2007 | Hill | 340/457 |
| 2007/0283875 | A1 | * | 12/2007 | Durkin | 116/173 |
| 2007/0283877 | A1 | * | 12/2007 | Durkin | 116/209 |

* cited by examiner

*Primary Examiner*—Randy W Gibson

(57) ABSTRACT

An emergency signaling apparatus includes a portable base member, a telescopically adjustable and rectilinear pole, a plurality of brackets, and a flag directly coupled to the brackets and adaptable between compressed and expanded positions when the brackets are displaced along a longitudinal length of the pole. A mechanism is included for simultaneously articulating and linearly displacing the pole about at least two mutually exclusive axes respectively in such a manner that the flag is automatically returned to an equilibrium position defined along a vertically oriented plane after being biased about the at least two mutually exclusive axes.

13 Claims, 13 Drawing Sheets

EMERGENCY FLAG APPARATUS AND ASSOCIATED METHOD

CROSS REFERENCE TO RELATED APPLICATIONS

This application claims the benefit of U.S. Provisional Application No. 60/861,278, filed Nov. 29, 2006, the entire disclosures of which are incorporated herein by reference.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to flags and, more particularly, to an emergency flag apparatus for notifying rescuers that a search area has already been cleared.

2. Prior Art

In the wake of catastrophic events like earthquakes, flash floods and large brush fires emergency, and search and rescue personnel are more than likely the first ones to enter the disaster area in order to look for survivors. During such endeavors the proper utilization of time and personnel is crucial for maximizing the possibility of finding survivors. Search and rescue personnel have thus created organized and methodical search strategies like canvassing large areas with the least amount of people possible. Another strategy is to divide a large group or personnel into smaller, more mobile and functional units that can actually accomplish more than one big group.

Unfortunately, in the chaos and confusion of the circumstances surrounding a disaster these search groups can actually waste valuable time by searching areas that have already been searched by another group. When performing organized searches from one residence to another, search teams will typically mark the doors and windows of a home in order to notify other teams that the house has already been canvassed. In the event of flashfloods, however, partially submerged vehicles must also be searched in addition to searching through residencies. There is no sufficient means for marking a vehicle, which can lead to costly wasting of time as a vehicle is searched that has already been searched. This can be particularly detrimental to a person who is trapped in a vehicle and is rapidly running out of air and time before they suffocate or drown.

U.S. Pat. No. 5,921,199 to Gross discloses a car locator having a base for attaching the locator to a car. A cantilevered support rod is pivotally connected with the base to permit pivotal movement and positioning of the rod relative to the base. A hollow marking sleeve having an outer transparent tube and an inner fluorescent liner disposed within the tube slidably mounts onto the support rod for marking the car. The sleeve engages the support rod with sufficient contact force to retain the sleeve in position on the support rod. The sleeve is slidably removable from the support rod so that the sleeve may be pulled from the support rod. Unfortunately, this prior art example is not telescopically adjustable for improved storage purposes.

U.S. Pat. No. 6,378,453 to Conway discloses a vehicle locator device including an easily visible flag with recognizable indicia thereon, such as vendor advertising logs, wherein the flag is supported above the top height of the vehicle by an elongated compression spring pole or mast at a distal end thereof. Because of the compression spring, the vehicle locator is foldable about itself into a loop, so that it can be reduced in size and fit within the glove compartment of a vehicle for storage when not in use. Unfortunately, this prior art example is not telescopically adjustable for improved storage purposes.

Accordingly, the present invention is disclosed in order to overcome the above noted shortcomings. The present invention is convenient and easy to use, lightweight yet durable in design, and designed for notifying rescuers that a search area has already been cleared. The emergency signaling apparatus is simple to use, inexpensive, and designed for many years of repeated use.

BRIEF SUMMARY OF THE INVENTION

In view of the foregoing background, it is therefore an object of the present invention to provide an apparatus for notifying rescuers that a search area has already been cleared. These and other objects, features, and advantages of the invention are provided by an emergency signaling apparatus.

An emergency signaling apparatus includes a portable base member and a telescopically adjustable and rectilinear pole coupled to the base member and extending upwardly therefrom. Such a pole includes first and second tubular shafts slidably interfitted within each other, and a third solid shaft is telescopically interfitted directly with the second shaft and directly connected to a plurality of brackets. Such brackets are slidably engaged with the pole and are linearly displaced along a longitudinal length of the third shaft such that the flag is effectively folded and unfolded as the brackets are compressed and separated respectively.

The apparatus further includes a flag directly coupled to the brackets and adaptable between compressed and expanded positions when the brackets are displaced along a longitudinal length of the pole. A mechanism is included for simultaneously articulating and linearly displacing the pole about at least two mutually exclusive axes respectively in such a manner that the flag is conveniently and automatically returned to an equilibrium position defined along a vertically oriented plane after being biased about the at least two mutually exclusive axes.

Such a simultaneous articulating and linearly displacing mechanism includes a plurality of linear slots formed within the base member and radially extending outward from a center thereof. Such linear slots are equidistantly juxtaposed along four quadrants of the base member, and a plurality of anchors is slidably seated within the slots such that the anchors advantageously slide from the center of the base member to a perimeter of the base member. A plurality of deformably resilient spring members has opposed ends directly coupled to the pole and the anchors respectively. Such spring members are coplanar.

The pole is effectively rotated about a fulcrum axis extending vertically upward from the base member such that the flag rotates about a first arcuate path. The pole is further linearly displaced along a selected one of the slots such that the flag becomes linearly offset from the center of the base member. The pole is pivoted along an x axis and a z-axis such that the flag is displaced downwardly along a second arcuate path and towards the base member.

A first pair of the spring members are conveniently compressed and extended along an x-axis when the pole is linearly displaced along a first linear path, and a second pair of the spring members are compressed and extended along a z-axis when the pole is linearly displaced along a second linear path. Such first and second linear paths are orthogonally registered, and the spring members and the anchors remain spaced from each other while the pole is articulated and linearly displaced during operating conditions.

A method for notifying rescuers that a search area has already been cleared includes the steps of: providing a portable base member; providing a telescopically adjustable and rectilinear pole coupled to the base member and extending upwardly therefrom; providing a plurality of brackets slidably engaged with the pole; providing a flag directly coupled to the brackets; adapting the flag between compressed and expanded positions by displacing the brackets along a longitudinal length of the pole; and simultaneously articulating and linearly displacing the pole about at least two mutually exclusive axes respectively in such a manner that the flag is automatically returned to an equilibrium position defined along a vertically oriented plane after being biased about the at least two mutually exclusive axes.

The method further includes the steps of: providing a plurality of linear slots formed within the base member and radially extending outward from a center thereof providing a plurality of anchors slidably seated within the slots such that the anchors slide from the center of the base member to a perimeter of the base member; providing a plurality of deformably resilient spring members with opposed ends directly coupled to the pole and the anchors respectively; rotating the pole about a fulcrum axis extending vertically upward from the base member such that the flag rotates about a first arcuate path; linearly displacing the pole along a selected one of the slots such that the flag becomes linearly offset from the center of the base member; pivoting the pole along an x-axis and a z-axis such that the flag is displaced downwardly along a second arcuate path and towards the base member.

The method further includes the steps of: compressing and extending a first pair of the spring members along an x-axis by linearly displacing the pole along a first linear path; and compressing and extending a second pair of the spring members along a z-axis by linearly displacing the pole along a second linear path.

The method further includes the steps of: maintaining the spring members and the anchors spaced from each other while the pole is articulated and linearly displaced during operating conditions; and linearly displacing the brackets along a longitudinal length of the third shaft by folding and unfolding the flag.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

Figure 1:
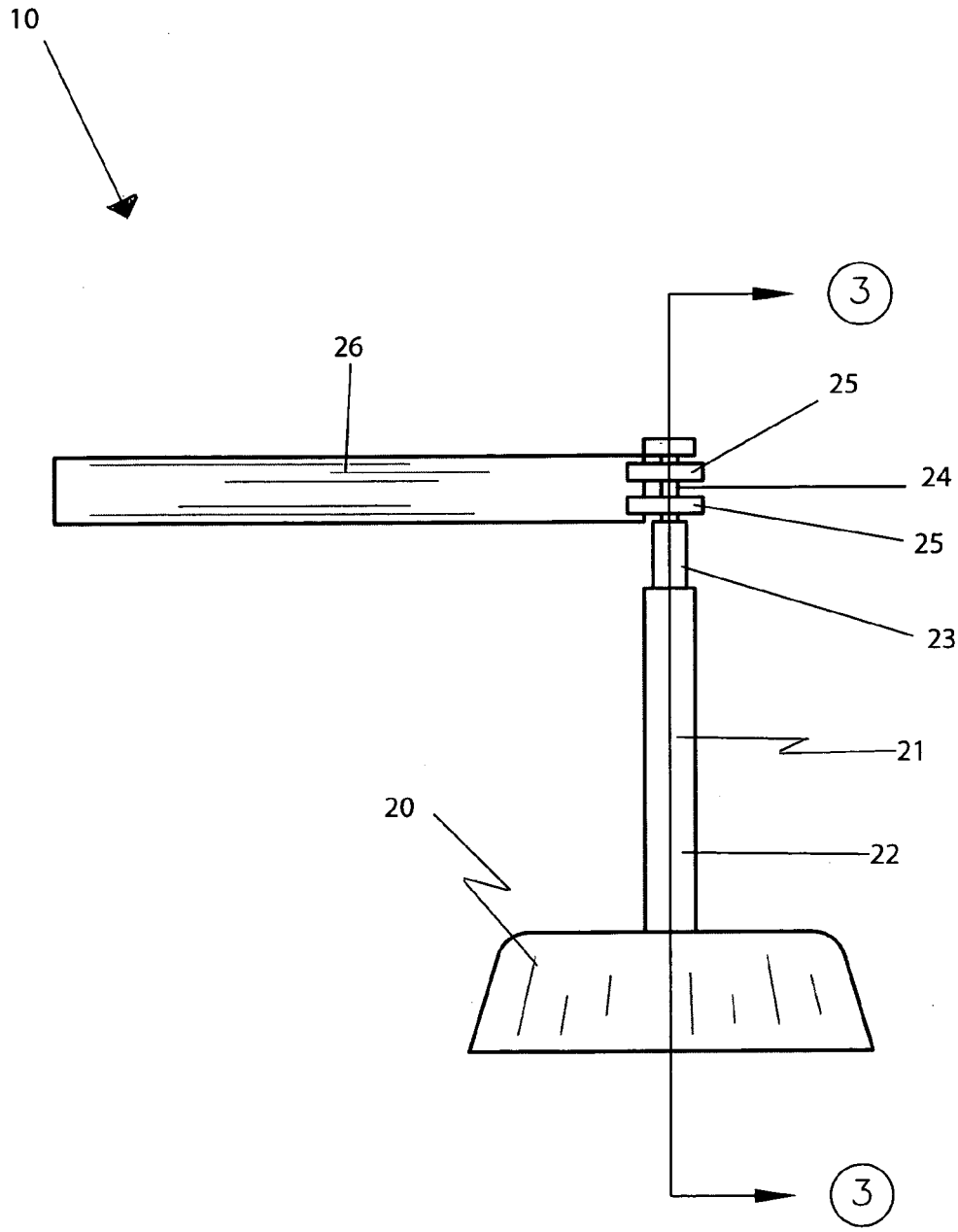
FIG. 1 is a side elevational view of an emergency signaling flag in a compressed position, in accordance with the present invention.
Figure 2:
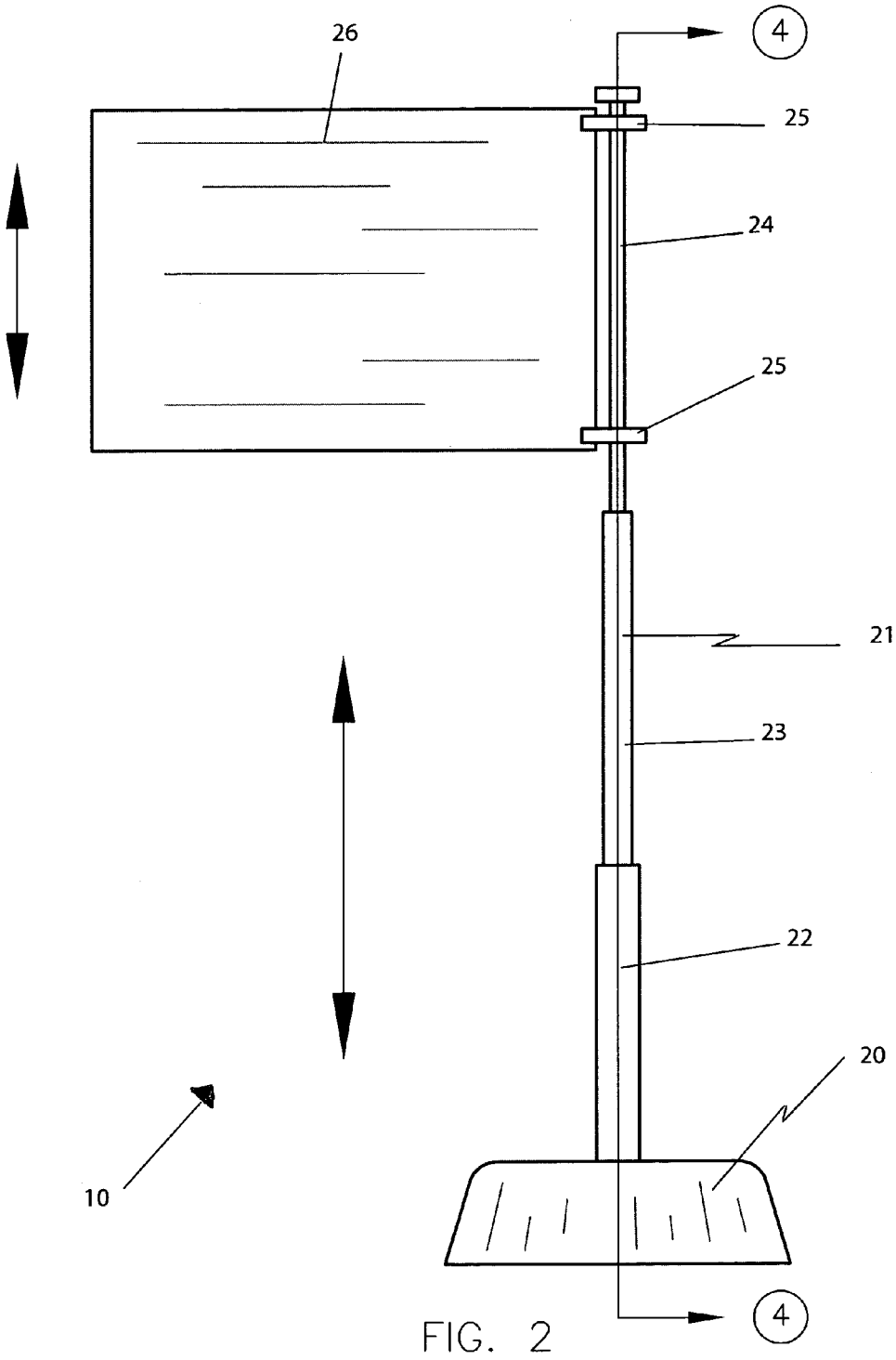
FIG. 2 is a side elevational view of an emergency signaling flag in an expanded position, in accordance with the present invention.
Figure 3:
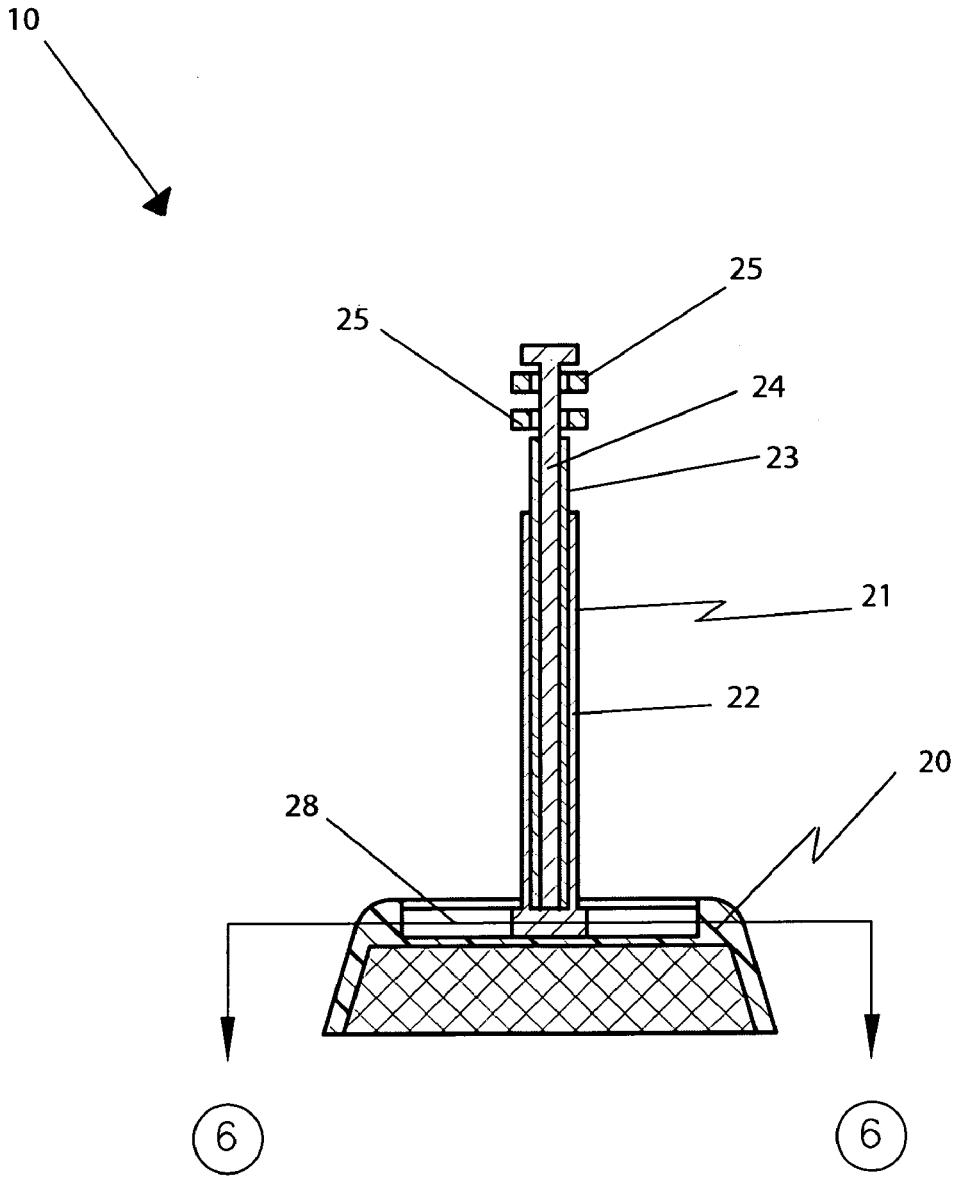
FIG. 3 is a cross sectional view of the present invention, taken along line 3-3, as seen in FIG. 1.
Figure 4:
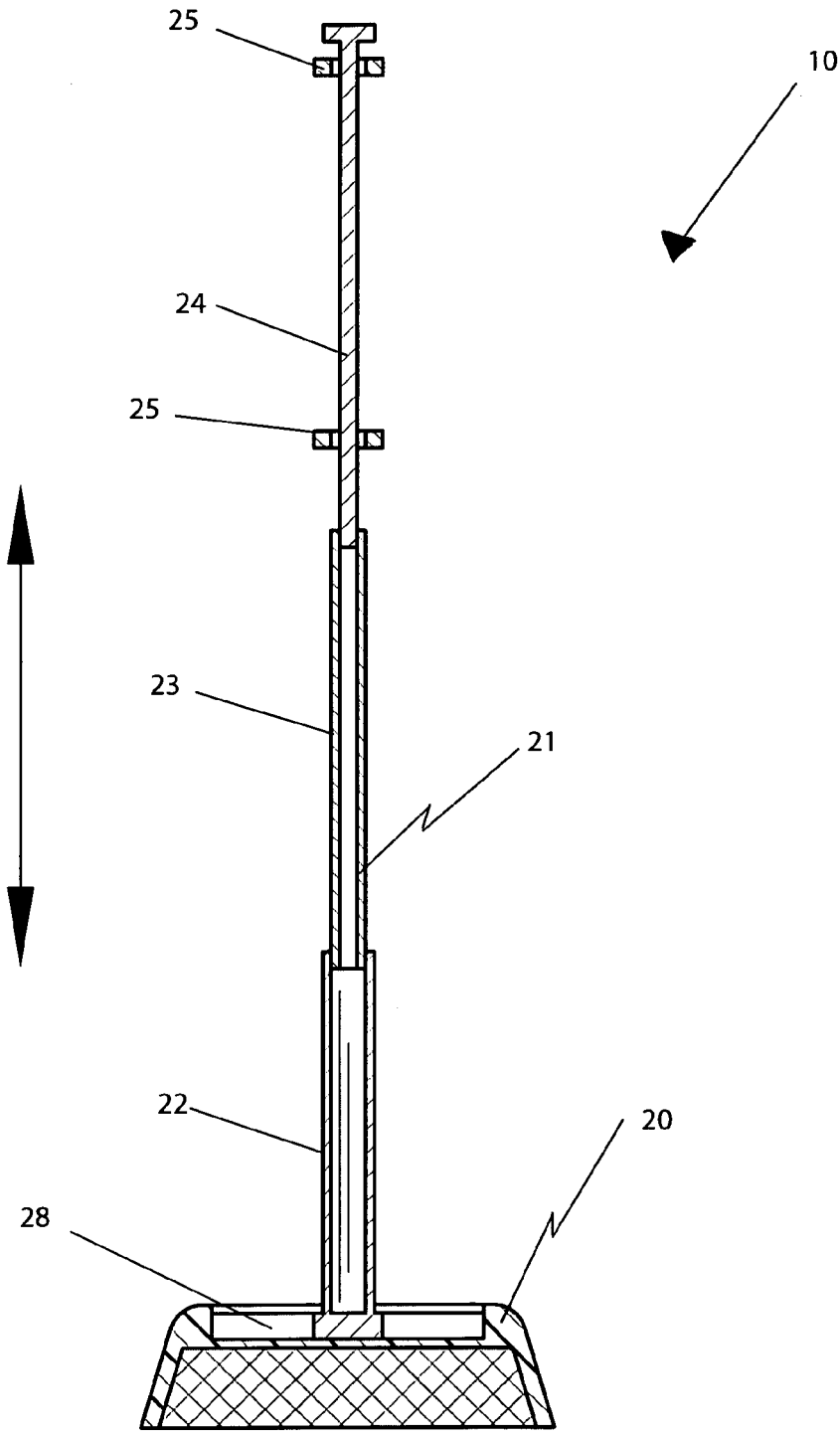
FIG. 4 is a cross sectional view of the present invention, taken along line 4-4, as seen in FIG. 2.
Figure 5:
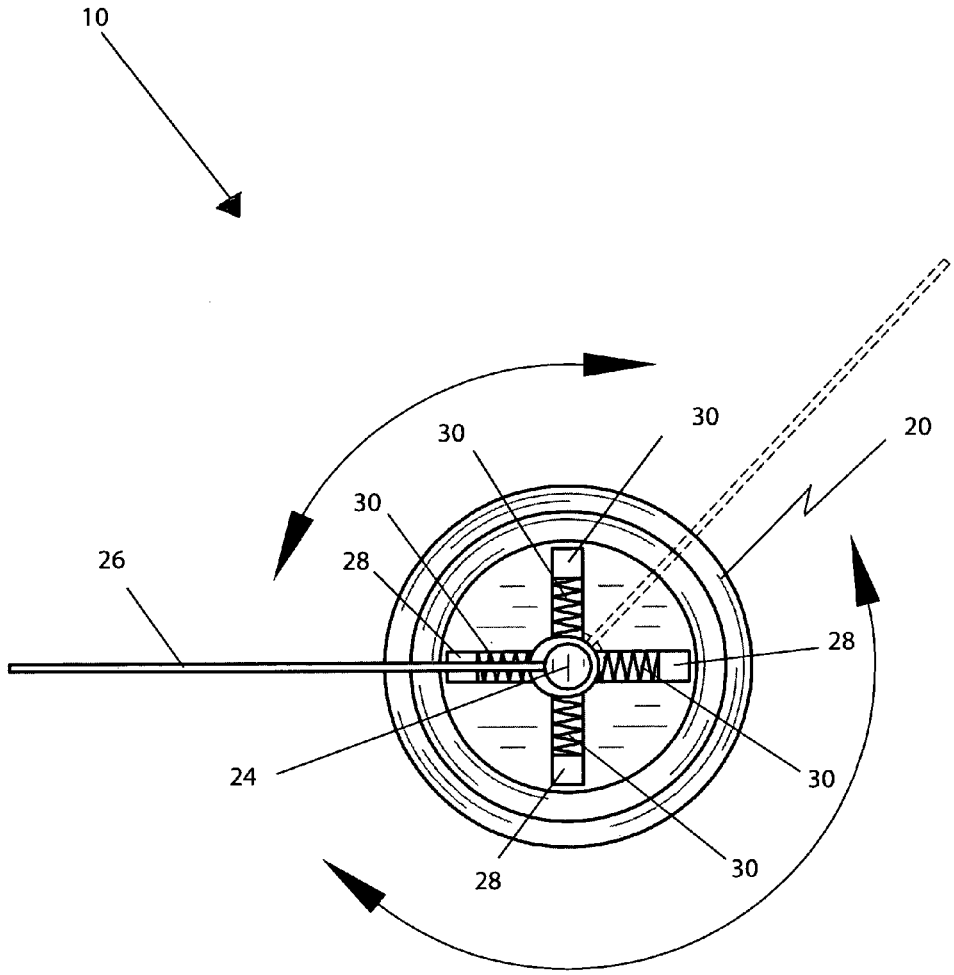
FIG. 5 is a top planar view of an emergency signaling flag, in accordance with the present invention.
Figure 6A:
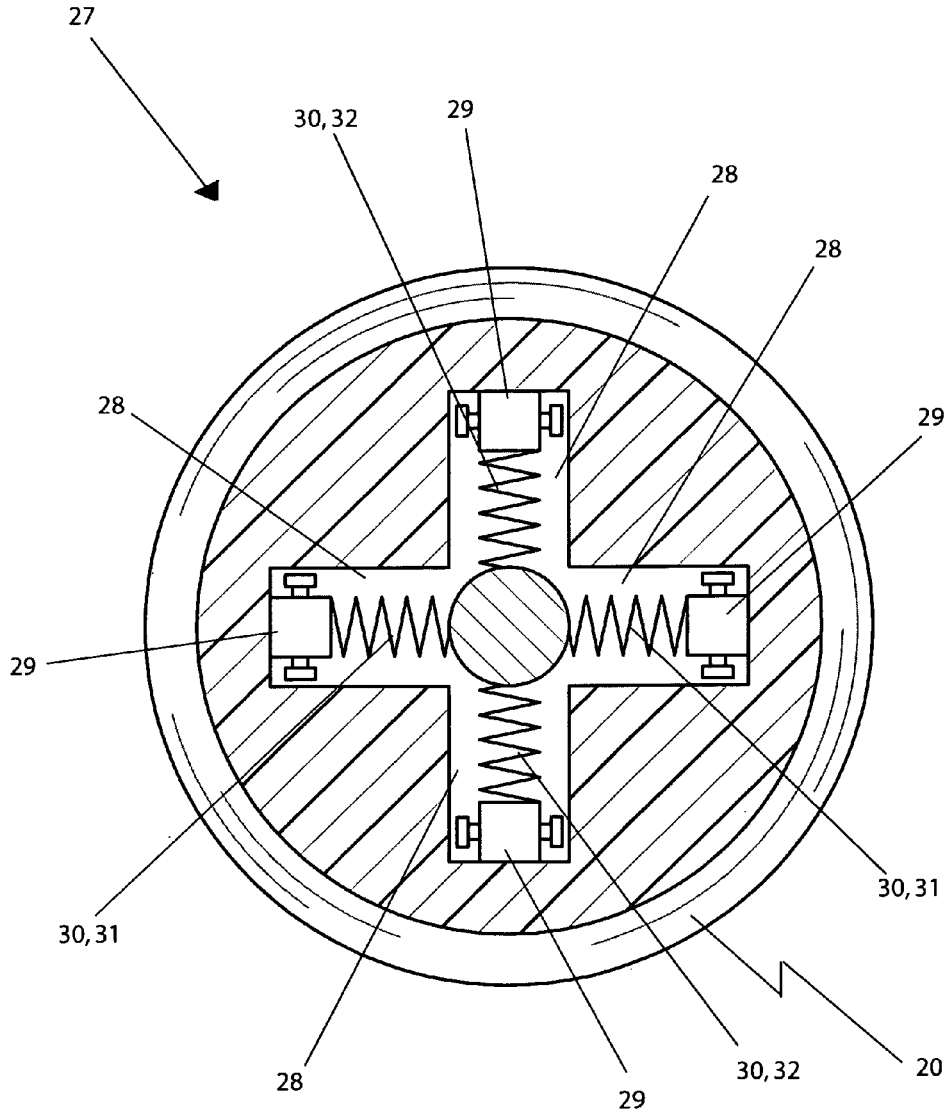
FIG. 6*a* is a cross sectional view of the displacing mechanism, taken along line 6-6, as seen in FIG. 3.
Figure 6B:
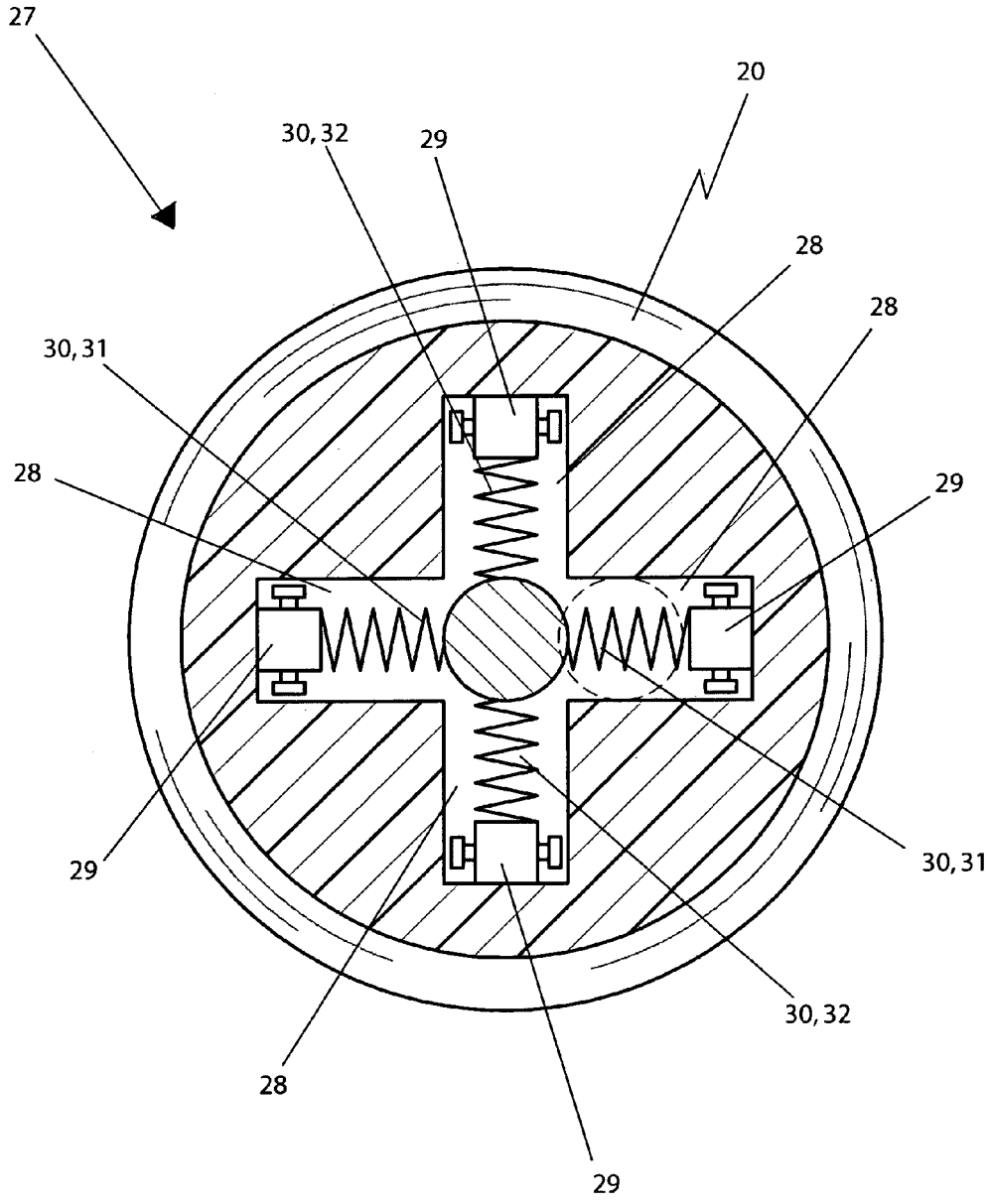
FIG. 6*b* is a cross sectional view of the displacing mechanism, taken along line 6-6, as seen in FIG. 3.
Figure 6C:
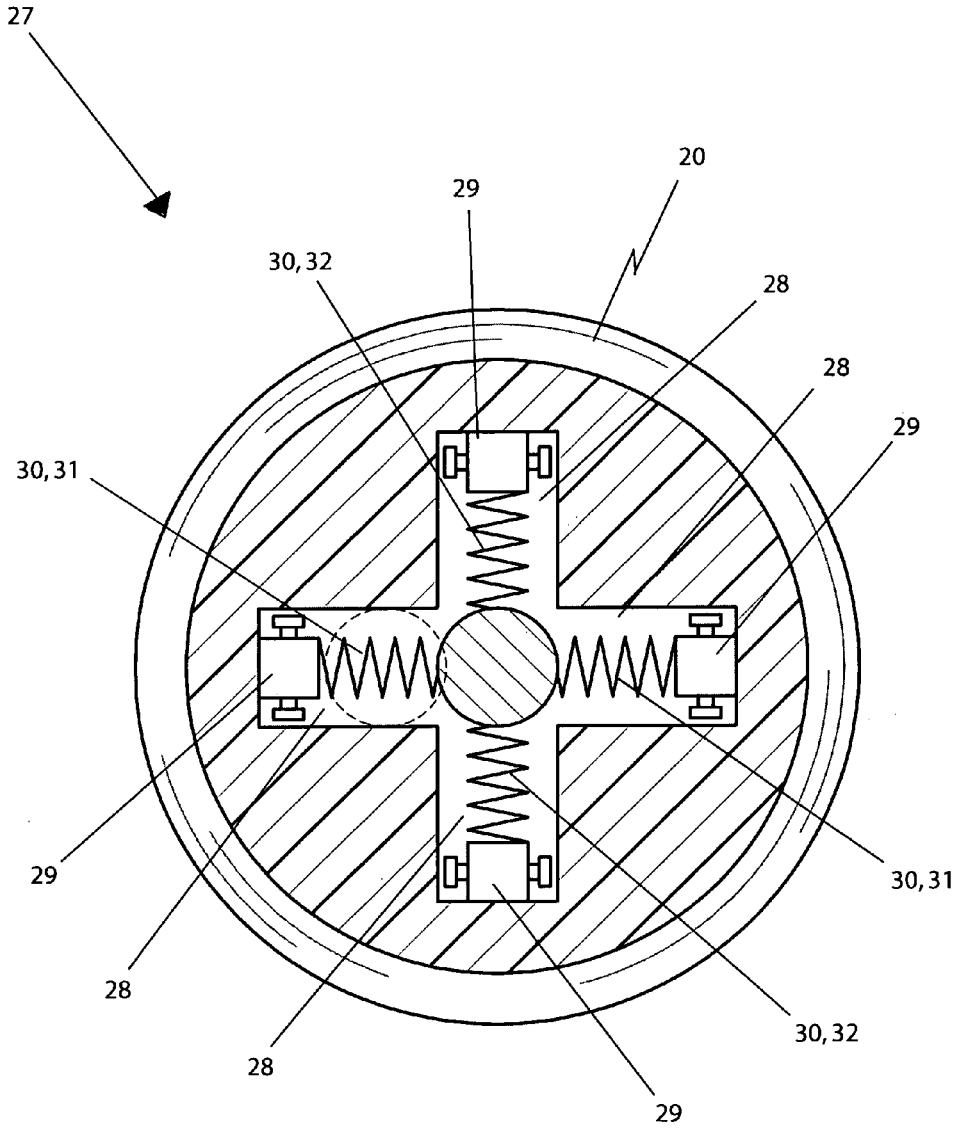
FIG. 6*c* is a cross sectional view of the displacing mechanism, taken along line 6-6, as seen in FIG. 3.
Figure 6D:
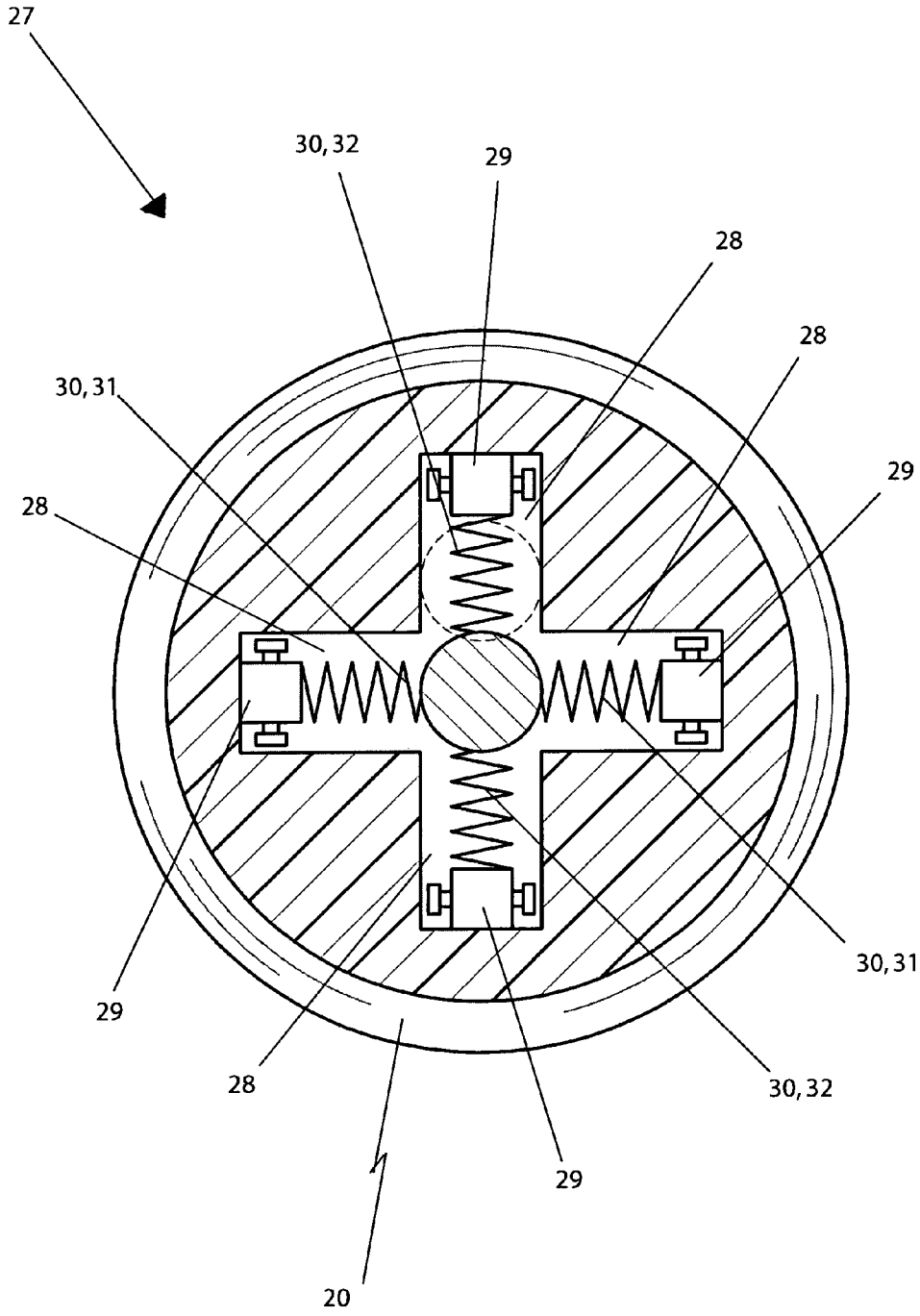
FIG. 6*d* is a cross sectional view of the displacing mechanism, taken along line 6-6, as seen in FIG. 3.
Figure 6E:
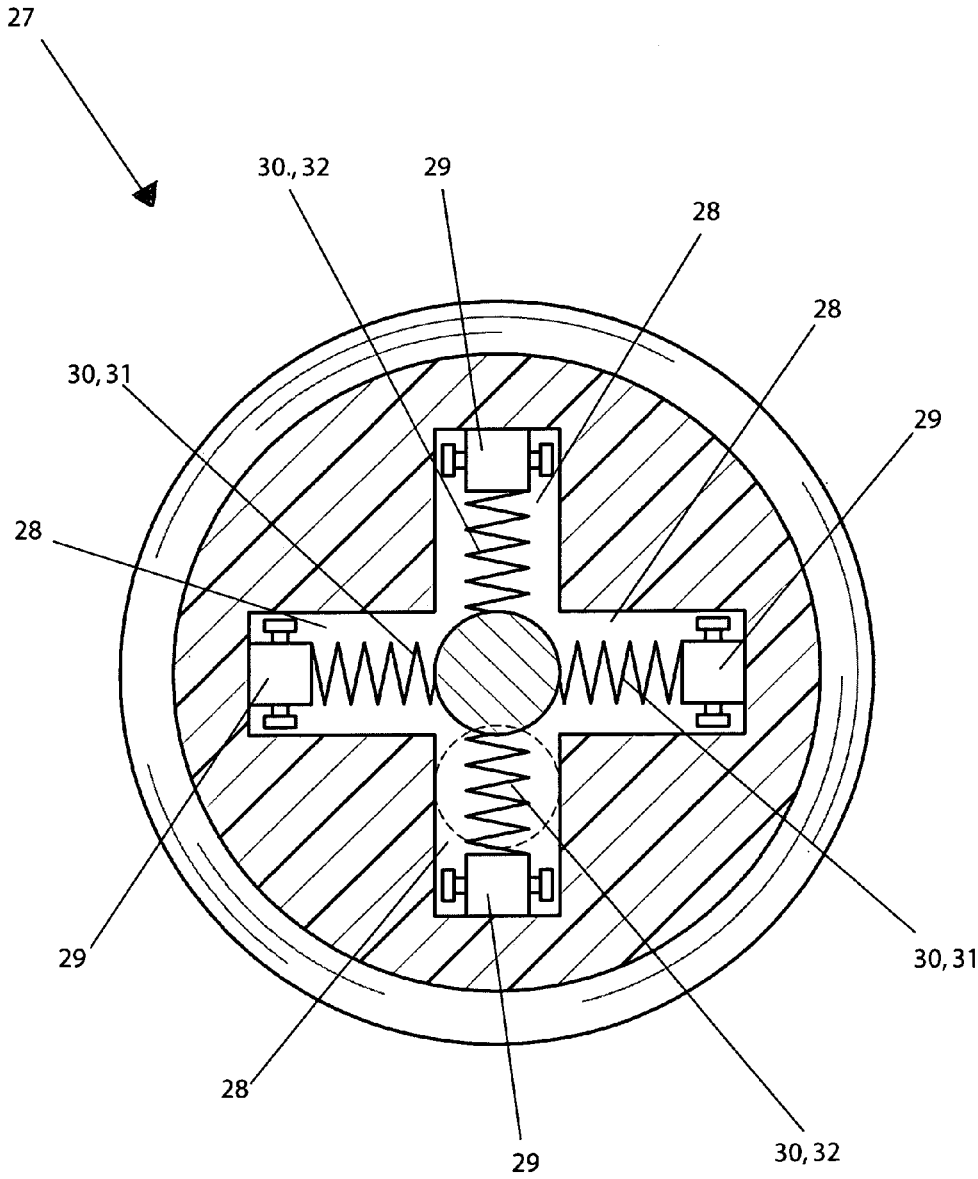
FIG. 6*e* is a cross sectional view of the displacing mechanism, taken along line 6-6, as seen in FIG. 3.
Figure 7:
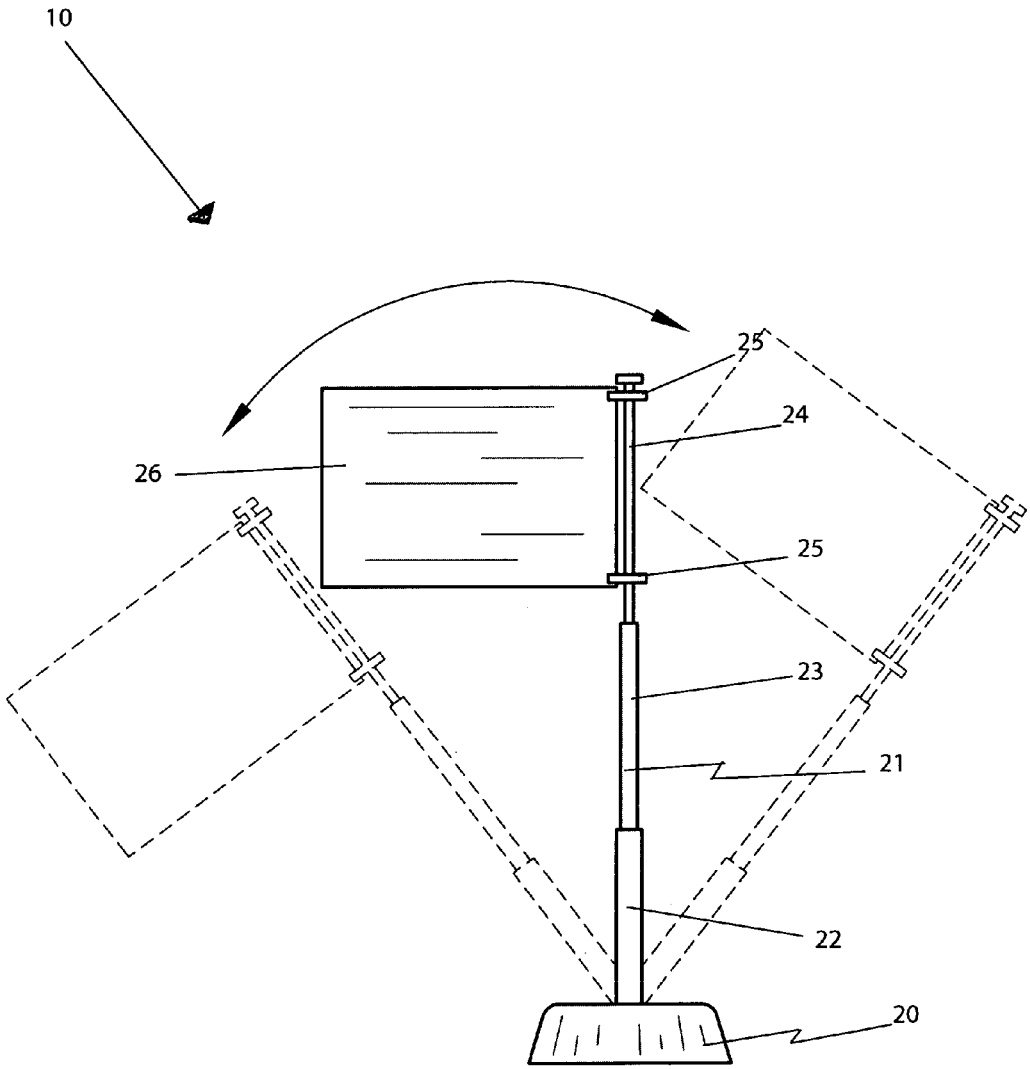
FIG. 7 is a side elevational view of an emergency signaling apparatus, showing the flag moving on an x-axis, according to the present invention.
Figure 8:
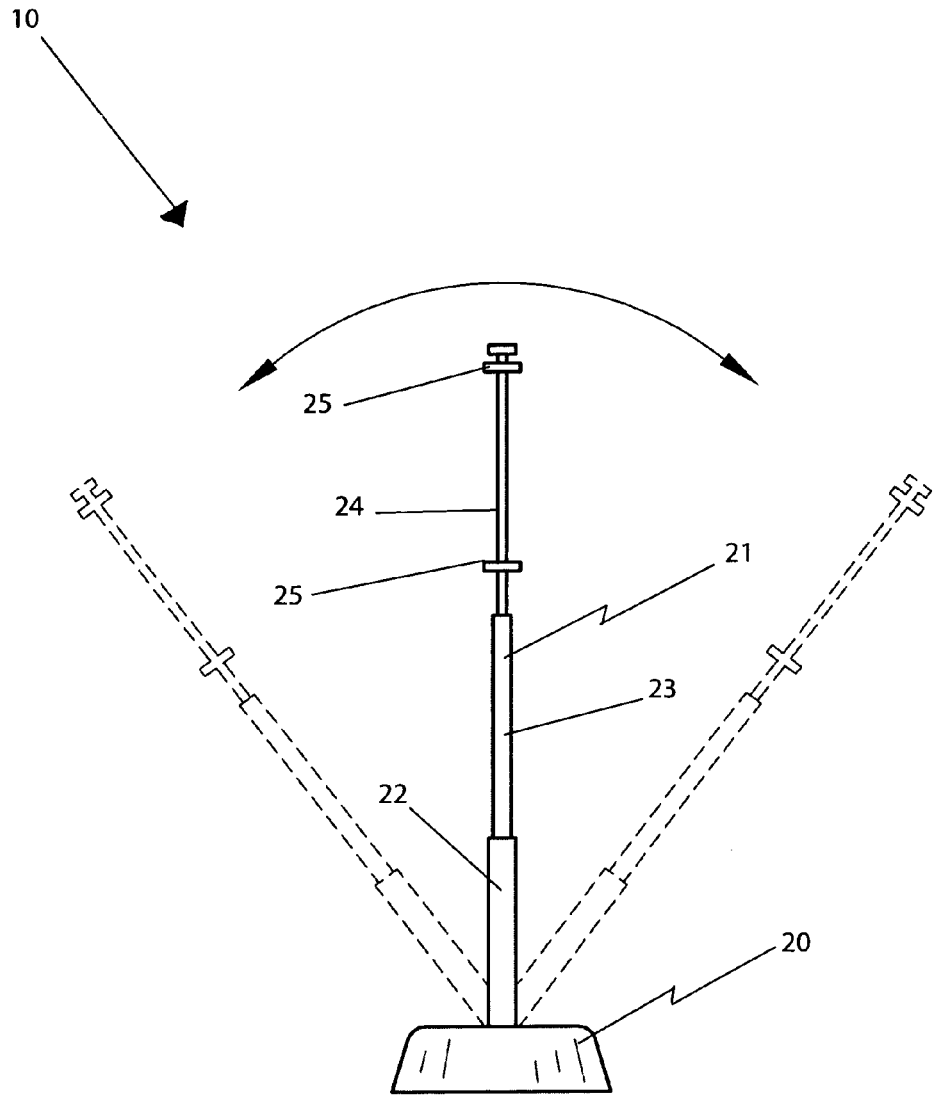
FIG. 8 is a rear elevational view of an emergency signaling apparatus, showing the flag moving on an x-axis, according to the present invention.
Figure 9:
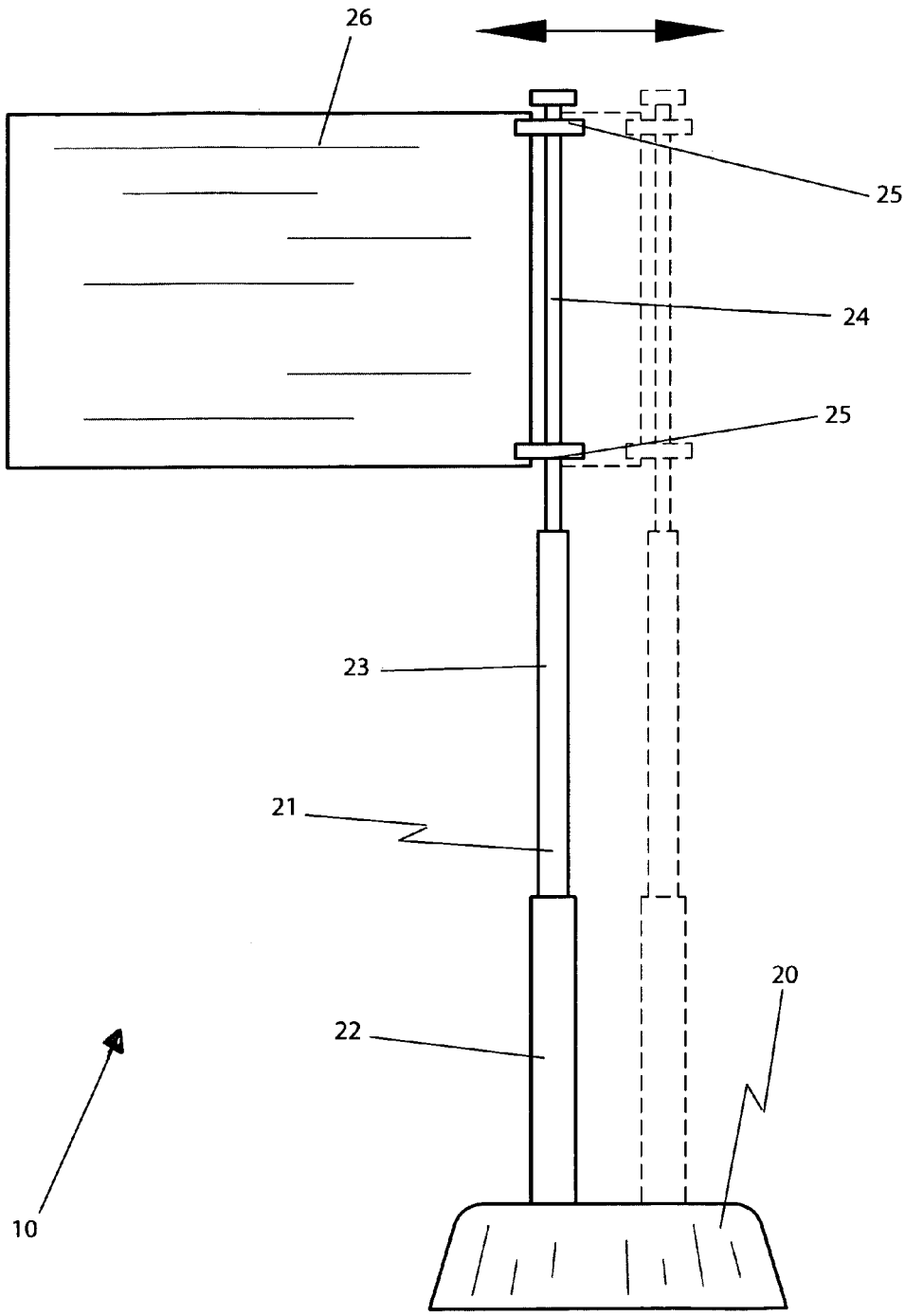
FIG. 9 is a side elevational view of an emergency signaling apparatus, in accordance with the present invention.

The apparatus of this invention is referred to generally in FIGS. 1-9 by the reference numeral 10 and is intended to protect an emergency signaling apparatus. It should be understood that the apparatus 10 may be used for signaling in many different types of situations and should not be limited to use in only those types of situations mentioned herein.

Referring to FIGS. 1, 2, 3, 4, 5, 7, 8 and 9, an emergency signaling apparatus 10 includes a portable base member 20 and a telescopically adjustable and rectilinear pole 21 coupled to the base member 20 and extending upwardly therefrom. Such a pole 21 includes first and second tubular shafts 22, 23 slidably interfitted within each other, and a third solid shaft 24 is telescopically interfitted directly, without the use of intervening elements, with the second shaft 23 and directly connected, without the use of intervening elements, to a plurality of brackets 25. Such brackets 25 are slidably engaged with the pole 21 and are linearly displaced along a longitudinal length of the third shaft 24 which is essential such that a flag 26 is folded and unfolded as the brackets 25 are compressed and separated respectively. The telescopic feature of the pole 21 enables the pole to be compressed for easy storage.

Referring to FIGS. 6*a*, 6*b*, 6*c*, 6*d* and 6*e*, the flag 26 is directly coupled, without the use of intervening elements, to the brackets 25 and adaptable between compressed and expanded positions when the brackets 25 are displaced along a longitudinal length of the pole 21. A mechanism 27 is included for simultaneously articulating and linearly displacing the pole 21 about at least two mutually exclusive axes respectively in such a manner that the flag 26 is automatically returned to an equilibrium position defined along a vertically oriented plane after being biased about the at least two mutually exclusive axes.

Such a simultaneous articulating and linearly displacing mechanism 27 includes a plurality of linear slots 28 formed within the base member 20 and radially extending outward from a center thereof. Such linear slots 28 are equidistantly juxtaposed along four quadrants of the base member 20, and a plurality of anchors 29 is slidably seated within the slots 28 which is vital such that the anchors 29 slide from the center of the base member 20 to a perimeter of the base member 20. A plurality of deformably resilient spring members 30 has opposed ends directly coupled, without the use of intervening elements, to the pole 21 and the anchors 29 respectively. Such spring members 30 are coplanar.

The pole 21 is rotated about a fulcrum axis extending vertically upward from the base member 20 which is important such that the flag 26 rotates about a first arcuate path. The pole 21 is further linearly displaced along a selected one of the slots 28 which is critical such that the flag 26 becomes linearly offset from the center of the base member 20. The pole 21 is pivoted along an x-axis and a z-axis which is essential such that the flag 26 is displaced downwardly along a second arcuate path and towards the base member 20. The displacing mechanism 27 allows the pole 21 to be moved on both an x-axis and a z-axis.

Referring again to FIGS. 6*a*, 6*b*, 6*c*, 6*d* and 6*e*, a first pair of the spring members 31 are compressed and extended along an x-axis when the pole 21 is linearly displaced along a first linear path, and a second pair of the spring members 32 are compressed and extended along a z-axis when the pole 21 is linearly displaced along a second linear path. Such first and second linear paths are orthogonally registered, and the spring members 30 and the anchors 29 remain spaced from each other while the pole 21 is articulated and linearly displaced during operating conditions.

The apparatus includes a circular-shaped base that has a magnet directly secured, without the use of intervening elements, to a bottom surface thereof. Such a magnet allows the base to securely fit onto a metallic portion of a dwelling, or on the top of a damaged or submerged vehicle. A high tensile flexible spring mechanism is centrally positioned on the base, which effectively serves to support a flag pole. Such a flag pole is brightly colored and measures approximately two to three inches in length. The flag pole is telescopically adjustable, which is crucial for adjusting the pole to greater heights for optimum visibility. A flag produced of fluorescent material is directly secured, without the use of intervening elements, to the top end of the pole via durable, reflective tape.

In use, the vehicle marker is easy and straightforward to operate. Emergency personnel simply attach the apparatus to a desired surface, thus assisting emergency personnel by serving as an "all clear" signal to other search and rescue teams that a dwelling or vehicle has already been searched and cleared. Since marker is able to be viewed from quite a distance, the "all clear" signal expediently informs others, with a simple glance that they can move on to search another area. In this manner, the flag advantageously eliminates wasteful duplicate searches, particularly in cases such as hurricane aftermaths when time is of the essence, and could mean life or death for stranded survivors. In addition, the present invention can help to keep rescue personnel safe as well, as they can avoid entering potentially dangerous areas that have already been searched.

The present invention, as claimed, provides the unexpected and unpredictable benefit of an apparatus that is convenient and easy to use, is durable yet lightweight in design, is versatile in its applications, and provides emergency personnel with an effective means to mark vehicles that have already been covered in a search. Such an apparatus is highly visible, thus ensuring that the vehicle it is attached to is clearly marked for identification as already having been searched. The present invention can also be attached to a variety of other surfaces for identifying various other locales as having been searched already.

In use, a method for notifying rescuers that a search area has already been cleared includes the steps of: providing a portable base member 20; providing a telescopically adjustable and rectilinear pole 21 coupled to the base member 20 and extending upwardly therefrom; providing a plurality of brackets 25 slidably engaged with the pole 21; providing a flag 26 directly coupled, without the use of intervening elements, to the brackets 25; adapting the flag 26 between compressed and expanded positions by displacing the brackets 25 along a longitudinal length of the pole 21; and simultaneously articulating and linearly displacing the pole 21 about at least two mutually exclusive axes respectively in such a manner that the flag 26 is automatically returned to an equilibrium position defined along a vertically oriented plane after being biased about the at least two mutually exclusive axes.

In use, the method further includes the steps of: providing a plurality of linear slots 28 formed within the base member 20 and radially extending outward from a center thereof providing a plurality of anchors 29 slidably seated within the slots such that the anchors 29 slide from the center of the base member 20 to a perimeter of the base member 20; providing a plurality of deformably resilient spring members 30 with opposed ends directly coupled, without the use of intervening elements, to the pole 21 and the anchors 29 respectively; rotating the pole 21 about a fulcrum axis extending vertically upward from the base member 20 such that the flag 26 rotates about a first arcuate path; linearly displacing the pole 21 along a selected one of the slots 28 such that the flag 26 becomes linearly offset from the center of the base member 20; pivoting the pole 21 along an x-axis and a z-axis such that the flag 26 is displaced downwardly along a second arcuate path and towards the base member 20.

In use, the method further includes the steps of: compressing and extending a first pair of the spring members 31 along an x-axis by linearly displacing the pole 21 along a first linear path; and compressing and extending a second pair of the spring members 32 along a z-axis by linearly displacing the pole 21 along a second linear path.

In use, the method further includes the steps of: maintaining the spring members 30 and the anchors 29 spaced from each other while the pole 21 is articulated and linearly displaced during operating conditions; and linearly displacing the brackets 25 along a longitudinal length of the third shaft 24 by folding and unfolding the flag 26.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. An emergency signaling apparatus for notifying rescuers that a search area has already been cleared, said emergency signaling apparatus comprising:

a base member;

a telescopically adjustable pole coupled to said base member and extending upwardly therefrom;

a plurality of brackets slidably engaged with said pole;

a flag directly coupled to said brackets and being adaptable between compressed and expanded positions when said brackets are displaced along a longitudinal length of said pole; and means for simultaneously articulating and linearly displacing said pole about at least two mutually exclusive axes respectively in such a manner that said flag is automatically returned to an equilibrium position defined along a vertically oriented plane after being biased about said at least two mutually exclusive axes;

wherein said simultaneous articulating and linearly displacing means comprises a plurality of linear slots formed within said base member and radially extending outward from a center thereof, said linear slots being equidistantly juxtaposed along four quadrants of said base member;

a plurality of anchors slidably seated within said slots such that said anchors slide from the center of said base member to a perimeter of said base member;

a plurality of deformably resilient spring members having opposed ends directly coupled to said pole and said anchors respectively, said spring members being coplanar;

wherein said pole is rotated about a fulcrum axis extending vertically upward from said base member such that said flag rotates about a first arcuate path;

wherein said pole is linearly displaced along a selected one of said slots such that said flag becomes linearly offset from the center of said base member;

wherein said pole is pivoted along an x-axis and a z-axis such that said flag is displaced downwardly along a second arcuate path and towards said base member;

wherein a first pair of said spring members are compressed and extended along an x-axis when said pole is linearly displaced along a first linear path, where in a second pair of said spring members are compressed and extended along a z-axis when said pole is linearly displaced along a second linear path;

wherein said first and second linear paths are orthogonally registered.

2. The signaling apparatus of claim 1, wherein said spring members and said anchors remain spaced from each other while said pole is articulated and linearly displaced during operating conditions.

3. The signaling apparatus of claim 1, wherein said pole comprises:

first and second tubular shafts slidably interfitted within each other; and a third solid shaft telescopically interfitted directly with said second shaft and directly connected to said brackets.

4. The signaling apparatus of claim 3, wherein said brackets are linearly displaced along a longitudinal length of said third shaft such that said flag is folded and unfolded as said brackets are compressed and separated respectively.

5. An emergency signaling apparatus for notifying rescuers that a search area has already been cleared, said emergency signaling apparatus comprising:

a portable base member;

a telescopically adjustable and rectilinear pole coupled to said base member and extending upwardly therefrom;

a plurality of brackets slidably engaged with said pole;

a flag directly coupled to said brackets and being adaptable between compressed and expanded positions when said brackets are displaced along a longitudinal length of said pole; and means for simultaneously articulating and linearly displacing said pole about at least two mutually exclusive axes respectively in such a manner that said flag is automatically returned to an equilibrium position defined along a vertically oriented plane after being biased about said at least two mutually exclusive axes;

wherein said simultaneous articulating and linearly displacing means comprises:

a plurality of linear slots formed within said base member and radially extending outward from a center thereof, said linear slots being equidistantly juxtaposed along four quadrants of said base member;

a plurality of anchors slidably seated within said slots such that said anchors slide from the center of said base member to a perimeter of said base member;

a plurality of deformably resilient spring members having opposed ends directly coupled to said pole and said anchors respectively, said spring members being coplanar;

wherein said pole is rotated about a fulcrum axis extending vertically upward from said base member such that said flag rotates about a first arcuate path;

wherein said pole is linearly displaced along a selected one of said slots such that said flag becomes linearly offset from the center of said base member;

wherein said pole is pivoted along an x-axis and a z-axis such that said flag is displaced downwardly along a second arcuate path and towards said base member.

6. The signaling apparatus of claim 5, wherein a first pair of said spring members are compressed and extended along an x-axis when said pole is linearly displaced along a first linear path, wherein a second pair of said spring members are compressed and extended along a z-axis when said pole is linearly displaced along a second linear path;

wherein said first and second linear paths are orthogonally registered.

7. The signaling apparatus of claim 5, wherein said spring members and said anchors remain spaced from each other while said pole is articulated and linearly displaced during operating conditions.

8. The signaling apparatus of claim 5, wherein said pole comprises:

first and second tubular shafts slidably interfitted within each other; and a third solid shaft telescopically interfitted directly with said second shaft and directly connected to said brackets.

9. The signaling apparatus of claim 8, wherein said brackets are linearly displaced along a longitudinal length of said third shaft such that said flag is folded and unfolded as said brackets are compressed and separated respectively.

10. A method for notifying rescuers that a search area has already been cleared, said method comprising the steps of:

a. providing a portable base member;

b. providing a telescopically adjustable and rectilinear pole coupled to said base member and extending upwardly therefrom;

c. providing a plurality of brackets slidably engaged with said pole;

d. providing a flag directly coupled to said brackets;

e. adapting said flag between compressed and expanded positions by displacing said brackets along a longitudinal length of said pole; and f. simultaneously articulating and linearly displacing said pole about at least two mutually exclusive axes respectively in such a manner that said flag is automatically returned to an equilibrium position defined along a vertically oriented plane after being biased about said at least two mutually exclusive axes;

wherein step f. comprises the steps of:

providing a plurality of linear slots formed within said base member and radially extending outward from a center thereof providing a plurality of anchors slidably seated within said slots such that said anchors slide from the center of said base member to a perimeter of said base member;

providing a plurality of deformably resilient spring members having opposed ends directly coupled to said pole and said anchors respectively rotating said pole about a fulcrum axis extending vertically upward from said base member such that said flag rotates about a first arcuate Path;

linearly displacing said pole along a selected one of said slots such that said flag becomes linearly offset from the center of said base member;

pivoting said pole along an x-axis and a z-axis such that said flag is displaced downwardly along a second arcuate path and towards said base member.

11. The method of claim 10, further comprising the steps of:

compressing and extending a first pair of said spring members along an x-axis by linearly displacing said pole along a first linear path; and compressing and extending a second pair of said spring members along a z-axis by linearly displacing said pole along a second linear path.

12. The method of claim 11, further comprising the steps of:

maintaining said spring members and said anchors spaced from each other while said pole is articulated and linearly displaced during operating conditions.

13. The method of claim 10, wherein step f. comprises the steps of:

linearly displacing said brackets along a longitudinal length of said third shaft by folding and unfolding said flag.

* * * * *